US009549641B1

(12) United States Patent
Frisbie

(10) Patent No.: US 9,549,641 B1
(45) Date of Patent: Jan. 24, 2017

(54) PORTABLE SPICE STORAGE CASE

(71) Applicant: Gordon Marshall Frisbie, Aurora, CO (US)

(72) Inventor: Gordon Marshall Frisbie, Aurora, CO (US)

( * ) Notice: Subject to any disclaimer, the term of this patent is extended or adjusted under 35 U.S.C. 154(b) by 0 days.

(21) Appl. No.: 15/166,142

(22) Filed: May 26, 2016

Related U.S. Application Data

(60) Provisional application No. 62/193,525, filed on Jul. 16, 2015.

(51) Int. Cl.

| | |
|---|---|
| ***B65D 85/00*** | (2006.01) |
| ***A47J 47/02*** | (2006.01) |
| ***A47B 73/00*** | (2006.01) |
| ***A45C 5/04*** | (2006.01) |
| ***A45C 13/36*** | (2006.01) |
| ***B65D 6/02*** | (2006.01) |
| ***B65D 8/00*** | (2006.01) |
| ***B65D 25/04*** | (2006.01) |
| ***B65D 25/10*** | (2006.01) |
| ***B65D 25/28*** | (2006.01) |

(52) U.S. Cl.
CPC ..... *A47J 47/02* (2013.01); *A45C 5/04* (2013.01); *A45C 13/36* (2013.01); *A47B 73/00* (2013.01); *B65D 9/06* (2013.01); *B65D 15/24* (2013.01); *B65D 25/04* (2013.01); *B65D 25/108* (2013.01); *B65D 25/2858* (2013.01)

(58) Field of Classification Search
USPC ..... 206/223, 541; 211/4, 74
See application file for complete search history.

(56) References Cited

U.S. PATENT DOCUMENTS

| | | | | |
|---|---|---|---|---|
| 1,723,658 | A | 8/1929 | Quade | |
| 2,236,368 | A | 3/1941 | Haaker | |
| 3,966,076 | A * | 6/1976 | Kroger | A45C 11/005 206/235 |
| 4,593,819 | A | 6/1986 | Will | |
| 6,082,556 | A * | 7/2000 | Primiano | A47F 1/12 211/59.2 |
| 7,156,226 | B1 * | 1/2007 | Van Sickle | A45C 11/20 206/1.5 |
| 7,232,194 | B2 * | 6/2007 | Becke | F25D 23/04 211/71.01 |
| 8,985,347 | B2 * | 3/2015 | Thompson | A47J 47/16 206/144 |
| 2006/0108240 | A1 * | 5/2006 | MacKinnon | A45C 13/02 206/223 |

(Continued)

*Primary Examiner* — Jacob K Ackun
(74) *Attorney, Agent, or Firm* — Plager Schack LLP

(57) ABSTRACT

Some embodiments of the present disclosure include a portable container for storing, organizing, and transporting bottles. The portable container being a case having an outer shell made of two openable halves having an interior and a back wall; a rear retainer attached to the back wall and running along the width of the interior, the rear retainer including a plurality of rounded grooves, each configured to accommodate a bottle; and a sliding bracket positioned within each interior, the sliding bracket being attached to the respective half but spaced away from the back wall, the sliding bracket having a plurality of rounded grooves, each configured to accommodate the bottle, such that when the sliding bracket is in a closed configuration, each bottle is sandwiched between the rear retainer and the sliding bracket.

10 Claims, 4 Drawing Sheets

(56) References Cited

U.S. PATENT DOCUMENTS

| | | | | |
|---|---|---|---|---|
| 2008/0272024 | A1* | 11/2008 | Fontanesi | A45C 13/02 206/576 |
| 2012/0160730 | A1 | 6/2012 | Andrews | |
| 2012/0298604 | A1* | 11/2012 | Fuhrer | A47B 88/06 211/78 |
| 2014/0014603 | A1* | 1/2014 | Thompson | A47F 5/02 211/78 |
| 2014/0091685 | A1 | 4/2014 | Greenwood | |
| 2015/0232262 | A1* | 8/2015 | Taylor | B65D 85/62 426/108 |
| 2015/0265019 | A1* | 9/2015 | Niedzwiecki | A45C 11/008 132/315 |

* cited by examiner

PORTABLE SPICE STORAGE CASE

RELATED APPLICATION

This application claims priority to provisional patent application U.S. Ser. No. 62/193,525 filed on Jul. 16, 2015, the entire contents of which is herein incorporated by reference.

BACKGROUND

The embodiments herein relate generally to storage devices, and more particularly, to a portable spice storage case.

For those who enjoy cooking while traveling or camping or for backyard barbeque masters, a large selection of spices that are well organized, easily accessible, and easily transported in a secure container is desired. However, currently there are no portable spice container systems that adequately meet these needs.

Therefore, what is needed is a portable storage case for spices, wherein the case prevents the spices from spilling while simultaneously ensuring that the containers the spices are stored in do not break.

SUMMARY

Some embodiments of the present disclosure include a portable container for storing, organizing, and transporting bottles. The portable container being a case having an outer shell made of two openable halves having an interior and a back wall; a rear retainer attached to the back wall and running along the width of the interior, the rear retainer including a plurality of rounded grooves, each configured to accommodate a bottle; and a sliding bracket positioned within each interior, the sliding bracket being attached to the respective half but spaced away from the back wall, the sliding bracket having a plurality of rounded grooves, each configured to accommodate the bottle, such that when the sliding bracket is in a closed configuration, each bottle is sandwiched between the rear retainer and the sliding bracket.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

In the following detailed description of the invention, numerous details, examples, and embodiments of the invention are described. However, it will be clear and apparent to one skilled in the art that the invention is not limited to the embodiments set forth and that the invention can be adapted for any of several applications.

The device of the present disclosure may be used to store, organize, and transport containers, such as containers of spices, and may comprise the following elements. This list of possible constituent elements is intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device.

1. Case Shell
2. Shelving
3. Bottle Restraints

The various elements of the device of the present disclosure may be related in the following exemplary fashion. It is not intended to limit the scope or nature of the relationships between the various elements and the following examples are presented as illustrative examples only.

Figure 1:
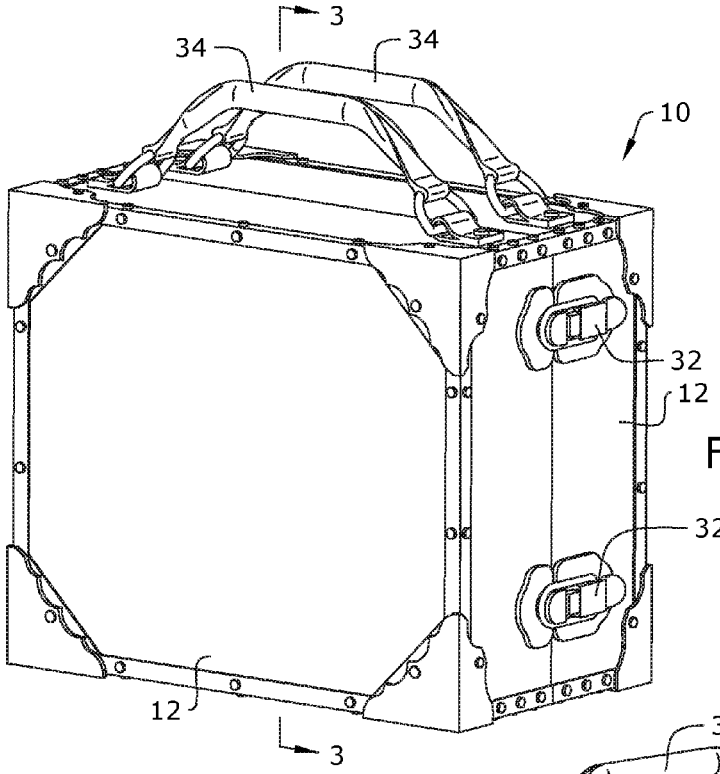
FIG. 1 is a perspective view of one embodiment of the present disclosure.
Figure 2:
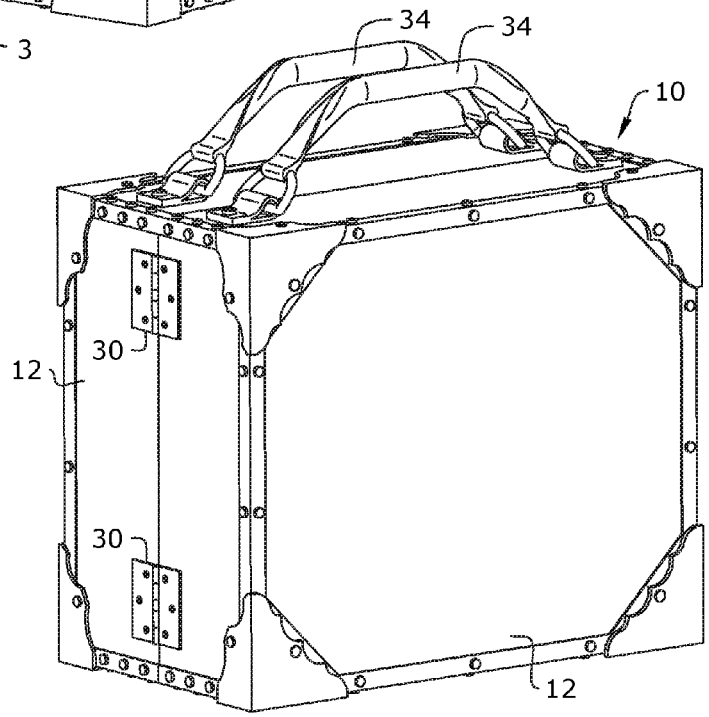
FIG. 2 is a perspective view of one embodiment of the present disclosure.

By way of example, and referring to FIGS. 1-8, some embodiments of the present disclosure include a portable spice container comprising a case 10 having an outer shell, wherein the interior of the case 10 is configured to accommodate a plurality of containers 28, such as cylindrical spice containers. The case 10 pay comprise a clam-shell type structure having a pair of case halves 12, wherein each case half 12 may comprise a box with one open side, wherein the case half 12 may be substantially square or rectangular in shape. Each of the halves 12 may have a handle 34 extending outwardly therefrom. At least one hinge 30, such as about two hinges 30, may hingeably attach the first case half 12 to the second case half 12. At least one latch 32, such as about two latches 32, may be positioned on a side of the halves 12 opposite the at least one hinge 30 such that the halves 12 may be latched together when the case 10 is in a closed configuration, as shown in FIG. 2. However, other closure devices are envisioned and may be used. In any case, a closure device on the first half 12 may be configured to engage with a closure device on the second half 12 to secure the case 10 in a closed configuration.

Figure 3:
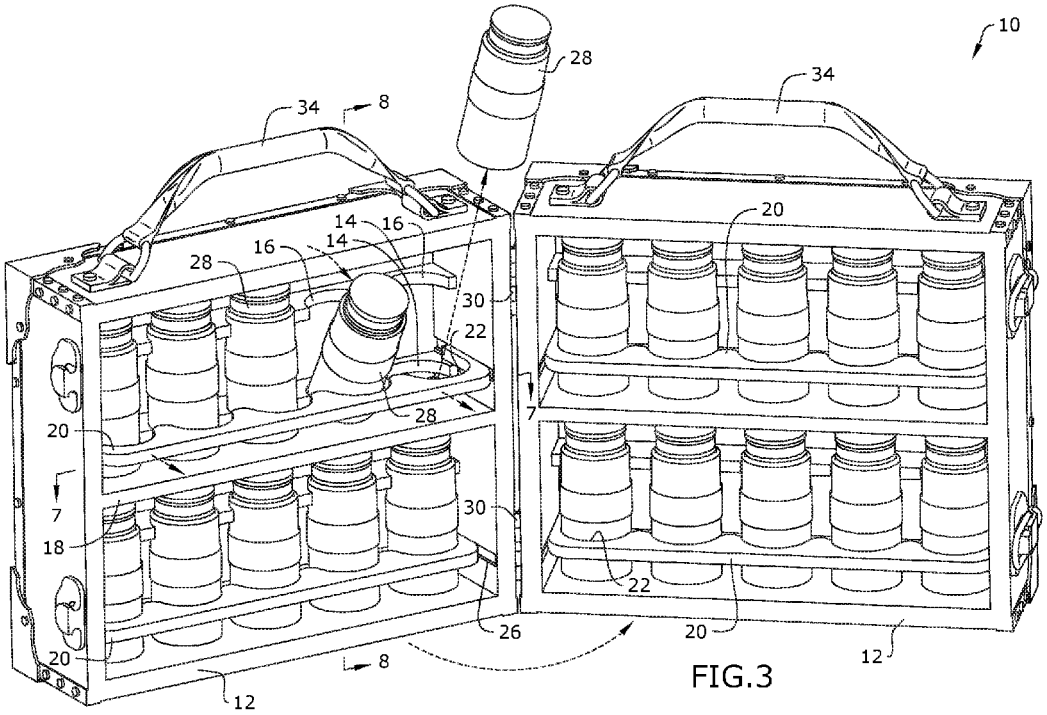
FIG. 3 is a perspective view of one embodiment of the present disclosure.
Figure 4:
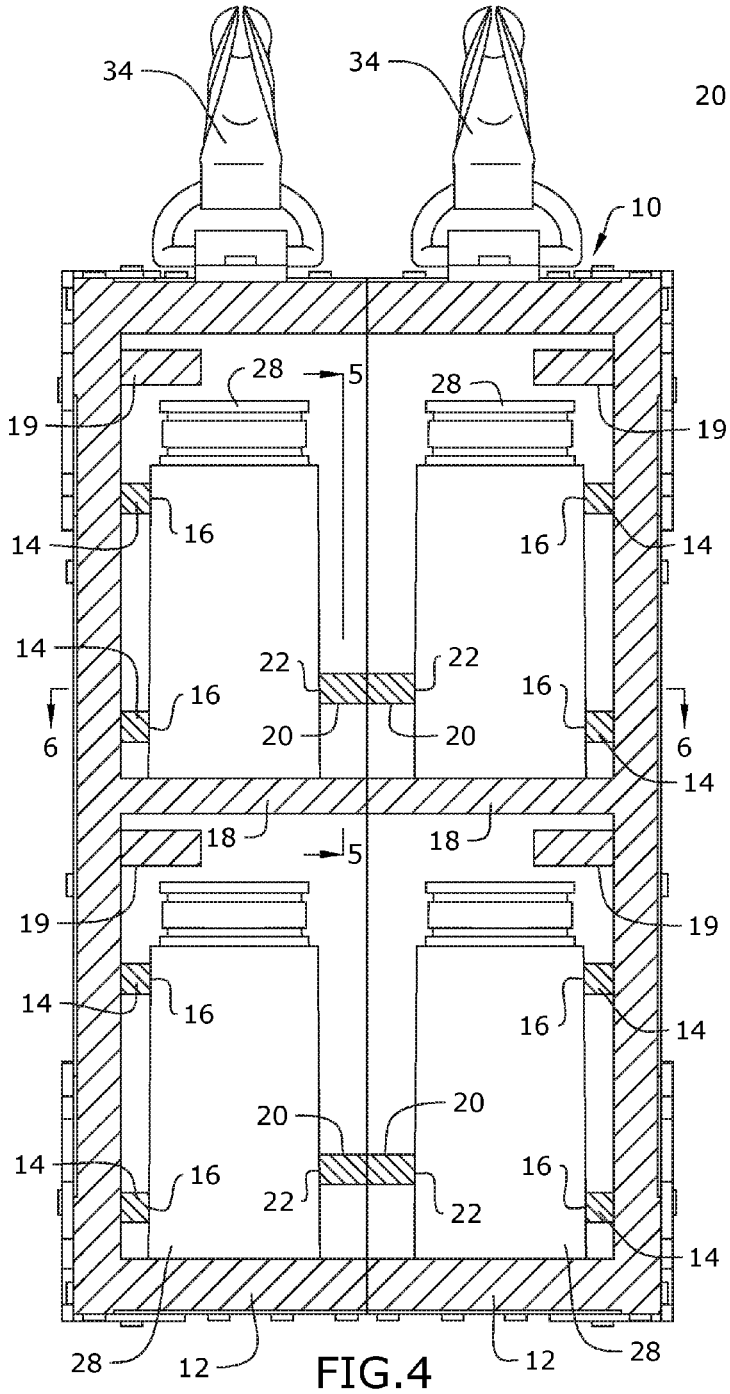
FIG. 4 is a section view of one embodiment of the present disclosure, taken along line 3-3 in FIG. 1.
Figure 5:
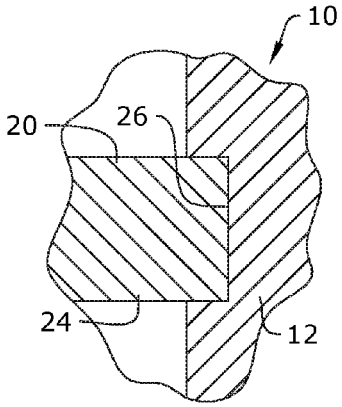
FIG. 5 is a section detail view of one embodiment of the present disclosure, taken along line 5-5 in FIG. 4.

An interior of each half 12 may define a storage space for containers 28, such as cylindrical spice containers, such that when the case 10 is closed, the storage space is inaccessible. As shown in FIG. 3, the interior of each half 12 may comprise at least one shelf 18 running across the width of the interior, separating the interior of the case 12 into multiple storage areas. The shelf 18 may be configured to accommodate the weight of multiple bottles 28. A rear retainer 14 may be positioned against a back wall of the interior of each case 12, the rear retainer 14 comprising a plurality of rounded grooves 16 configured to accommodate the diameter of a container 28. In some embodiments, each storage area may comprise two or more rear retainers 14. For example, as shown in FIG. 4, each storage area may comprise a rear retainer 14 positioned proximate to a top of the bottle 28 and a rear retainer 14 positioned proximate to a bottom of the bottle 28. The rear retainers 14 may function to help prevent the bottles 28 from contacting each other when the case 10 is closed and being transported.

Embodiments of the case 10 may further comprise a restraining shelf 19 positioned along the back wall of the interior and vertically above the rear retainer 14 and the tops of the bottles 28, wherein the restraining shelf 19 is positioned slightly above the height of a bottle 28, such that when the case 10 is flipped upside down with the case 10 closed, the tops of the bottles 28 do not contact the shelf 18 or the top of the half 12 above the bottles 28, respectively.

Figure 6:
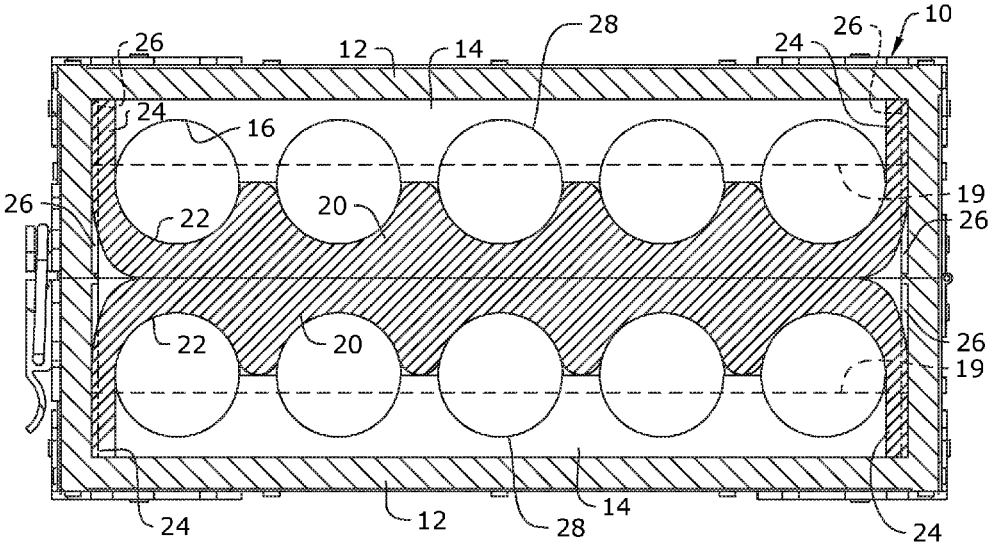
FIG. 6 is a section view of one embodiment of the present disclosure, taken along line 6-6 in FIG. 4.
Figure 7:
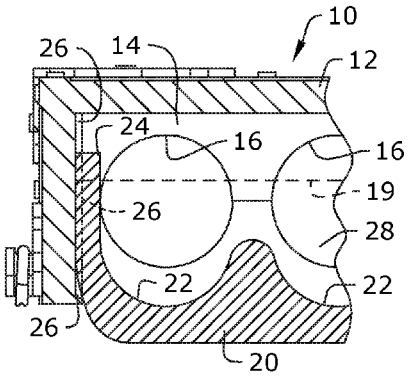
FIG. 7 is a section detail view of one embodiment of the present disclosure, taken along line 7-7 in FIG. 3.
Figure 8:
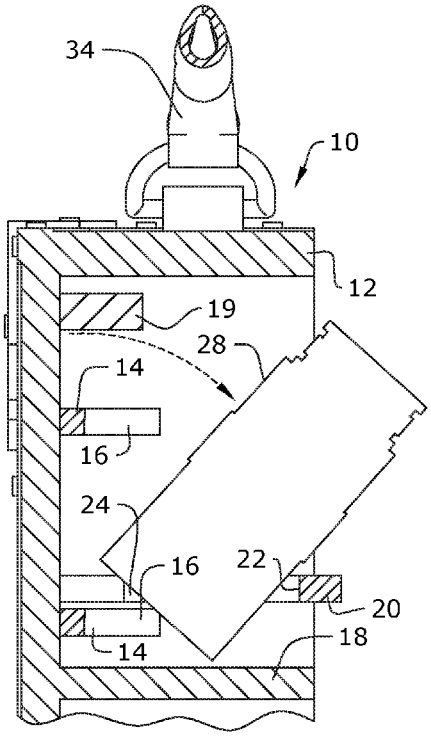
FIG. 8 is a section detail view of one embodiment of the present disclosure, taken along line 8-8 in FIG. 3.

A sliding bracket 20 may also be positioned within the interior of each half 12, wherein the sliding bracket 20 may extend the entire width of the half 12 but may not be attached to the back wall, as shown in FIGS. 3 and 4. At least one end of the sliding bracket 20 may be configured to engage with a side slot 26 in the half 12, allowing the sliding bracket 20 to move forward to an open position, as shown in FIGS. 7 and 8, or back to a closed position, as shown in FIG. 6. The sliding bracket 20 may comprise a plurality of rounded grooves 22 configured to accommodate the diameter of a bottle 28, wherein when a bottle 28 is on the shelf 18 and the sliding bracket 20 is closed, the sliding bracket 20 may prevent the bottle 28 from falling off of the shelf 18 and from contacting bottles 28 stored in the other half 12 of the case 10, as shown in FIG. 4. In fact, the sliding bracket 20 from the first half 12 may abut the sliding bracket 20 from the second half 12 when the case 10 is closed, as shown in FIG. 4, helping to securing the bottles 28 in place.

The case 10 may be sized to accommodate any desired number of bottles 28 and, in some embodiments, each half 12 may comprise a single shelf 18 dividing the half 12 into two storage areas. Each storage area may hold about five bottles 28, as shown in FIG. 3. Thus, each of the rear retainers 14 and the sliding brackets 20 may comprise about five rounded groves 16, 22. Accordingly, a particular embodiment of the case 10 may be designed to store about 20 bottles 28. Because of the structure of the case 10, the case 10 may accommodate bottles 28 stored in any upright position, allowing the bottles 28, their contents, and their labels to be visible when the case 10 is open, as shown in FIG. 3. The case 10 may securely hold the bottles 28 in place while the case 10 is closed, as shown in FIGS. 4 and 6.

To use the case 10 of the present disclosure, a user may place the desired contents into the bottles 28 that are designed to fit within the case 10. The bottles 28 may be placed on the shelves 18 or on the base of each half 12, wherein the rear retainer 14 and the sliding bracket 20 may help secure the bottles 28 in place. The case 10 may then be closed and latched shut. A user may transport the case 10 using the handles 34. Because of the structure of the case 10, when the case 10 is closed, the bottles 28 may be securely retained within the case 10 relative to any horizontal or vertical movement. When intended for use, the case 10 may be placed on a flat surface with the handles 34 extending upward toward the sky. The case 10 may be unlatched and open, giving a user access to the bottles 28 stored therein.

While the case 10 of the present disclosure is described above as being used to store spices, the case 10 may be used to store any contents configured to fit within the containers 28. For example, the case 10 may hold a variety of art supplies, liquids, office supplies, knick knacks, or the like.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A portable container for storing a plurality of bottles, the portable container comprising a case comprising:

an outer shell comprising two openable halves having an interior and a back wall;

a shelf extending an entire width of each openable half, the shelf configured to accommodate a plurality of bottles, the shelf separating the interior into multiple storage areas;

a rear retainer attached to the back wall and running along the width of each storage area, the rear retainer comprising a plurality of rounded grooves, each configured to accommodate a bottle; and a sliding bracket positioned within each storage area, the sliding bracket being attached to the interior but spaced away from the back wall, the sliding bracket comprising a plurality of rounded grooves, each configured to accommodate the bottle, such that when the sliding bracket is in a closed configuration, each bottle is sandwiched between the rear retainer and the sliding bracket.

2. The portable container of claim 1, further comprising a restraining shelf positioned proximate to a top of each storage area and extending along the width of the storage area, such that the restraining shelf is vertically above a bottle positioned within the storage area, wherein the restraining shelf prevents the bottle from upward movement when the case is moved.

3. The portable container of claim 1, wherein each storage area comprises a pair of rear retainers, a first rear retainer positioned proximate to a top of the bottles and a second rear retainer positioned proximate to a bottom of the bottles.

4. The portable container of claim 1, wherein each storage area is configured to accommodate about 5 bottles.

5. The portable container of claim 4, wherein each rear retainer comprises about 5 rounded grooves, and each sliding bracket comprises about 5 rounded grooves.

6. The portable container of claim 1, wherein the sliding bracket is slidably attached to the interior of its respective half.

7. The portable container of claim 1, wherein the openable halves are hingeably attached to one another via a pair of hinges.

8. The portable container of claim 1, further comprising a handle extending outward from each of the openable halves.

9. The portable container of claim 1, further comprising a closing device configured to lock the openable halves in a closed configuration.

10. A portable container for storing, organizing, and transporting bottles, the portable container comprising a case comprising:

an outer shell comprising two openable halves having an interior and a back wall;

a rear retainer attached to the back wall and running along the width of the interior, the rear retainer comprising a plurality of rounded grooves, each configured to accommodate a bottle; and a sliding bracket positioned within each interior, the sliding bracket being attached to the respective half but spaced away from the back wall, the sliding bracket comprising a plurality of rounded grooves, each configured to accommodate the bottle, such that when the sliding bracket is in a closed configuration, each bottle is sandwiched between the rear retainer and the sliding bracket.

* * * * *